US006419612B1

(12) United States Patent
Yu

(10) Patent No.: US 6,419,612 B1
(45) Date of Patent: Jul. 16, 2002

(54) JOGGING MACHINE PROVIDED WITH MEANS FOR EASY MOVEMENT OF SAME

(76) Inventor: Jessica Yu, 1F, No. 1, Lane 50, Sec. 1, Chung San N. Rd., Yang Mei Chen, Taoyuan Hsien (TW)

( * ) Notice: Subject to any disclaimer, the term of this patent is extended or adjusted under 35 U.S.C. 154(b) by 0 days.

(21) Appl. No.: 09/552,563

(22) Filed: Apr. 19, 2000

(51) Int. Cl.[7] ..... A63B 22/02
(52) U.S. Cl. ..... 482/54
(58) Field of Search ..... 482/54, 71

(56) References Cited

U.S. PATENT DOCUMENTS 5,868,648 A * 2/1999 Coody et al. ..... 482/54
5,904,637 A * 5/1999 Kuo ..... 482/54
6,050,923 A * 4/2000 Yu ..... 482/54
6,059,695 A * 5/2000 Hung ..... 482/54
6,077,200 A * 6/2000 Lin ..... 482/54
6,123,648 A * 9/2000 Stevens ..... 482/54
6,135,925 A * 10/2000 Liu ..... 482/54

* cited by examiner

*Primary Examiner*—Stephen R. Crow
(74) *Attorney, Agent, or Firm*—Browdy and Neimark, P.L.L.C.

(57) ABSTRACT

A jogging machine comprises a main frame and a jogging seat pivoted to the main frame. The main frame is provided with a plurality of casters in contact with a floor on which the jogging machine is rested. The jogging seat is provided at one end thereof with one or more rollers, which come in contact with the floor at such time when the jogging seat is turned in relation to the base frame to be in an upright position perpendicular to the main frame. The movement of the jogging machine on the floor is made easy by virtue of the casters of the main frame and the rollers of the jogging seat.

2 Claims, 4 Drawing Sheets

JOGGING MACHINE PROVIDED WITH MEANS FOR EASY MOVEMENT OF SAME

FIELD OF THE INVENTION

The present invention relates generally to a jogging machine, and more particularly to structures for easy movement of the jogging machine.

BACKGROUND OF THE INVENTION

As shown in FIG. 1, a prior art jogging machine comprises a base 1, an upright frame 2 mounted on the base 1, a jogging seat 3 pivoted to the upright frame 2, and two casters 4 mounted under the front end of the base 1 which is in contact with the floor. In moving the jogging machine, the jogging seat 3 is first raised upright before the upright frame 2 is tilted such that only the casters 4 are in contact with the floor, as illustrated by the imaginary lines in FIG. 1. In light of the cumbersome volume of the prior art jogging machine, it is not easy to move the jogging machine with hands.

As shown in FIG. 2, another prior art jogging machine comprises a base 5, an upright frame 6, a jogging seat 7, two casters 8 fastened an upright frame 6, a jogging seat 7, two casters 8 fastened pivotally with the base 5, and a plurality of arresting blocks 9 which can be adjusted in direction to support the casters 8 on the floor so as to stabilize the jogging machine on the floor. In moving the jogging machine on the floor, the jogging seat 7 is first lifted upright, as shown by the imaginary lines in FIG. 2, before the arresting blocks 9 are once again adjusted in direction such that the casters 8 come in contact with the floor, thereby enabling the jogging machine to be moved easily on the floor. Such a moving structure as described above is defective in design in that one end of the jogging machine must be lifted to facilitate the adjusting of the arresting blocks 9. In other words, the user of the jogging machine is apt to be annoyed at the repeated adjustments of the arresting blocks 9.

SUMMARY OF THE INVENTION

The primary objective of the present invention is to provide a jogging machine with a structure enabling a user of the jogging machine to move the jogging machine easily on the floor. The structure also serves to stabilize the jogging machine in action.

In keeping with the principle of the present invention, the foregoing objective of the present invention is attained by a jogging machine comprising a main frame and a jogging seat. The main frame is provided in the underside thereof with a caster set in contact with the floor. The jogging seat is pivotally fastened at one end thereof with the main frame such that the jogging seat can be raised upright, and that a roller of the jogging seat comes in contact with the floor at the time when the jogging seat is raised upright. The jogging machine can be thus easily moved on the floor by the caster set and the roller.

DETAILED DESCRIPTION OF THE INVENTION

Figure 3:
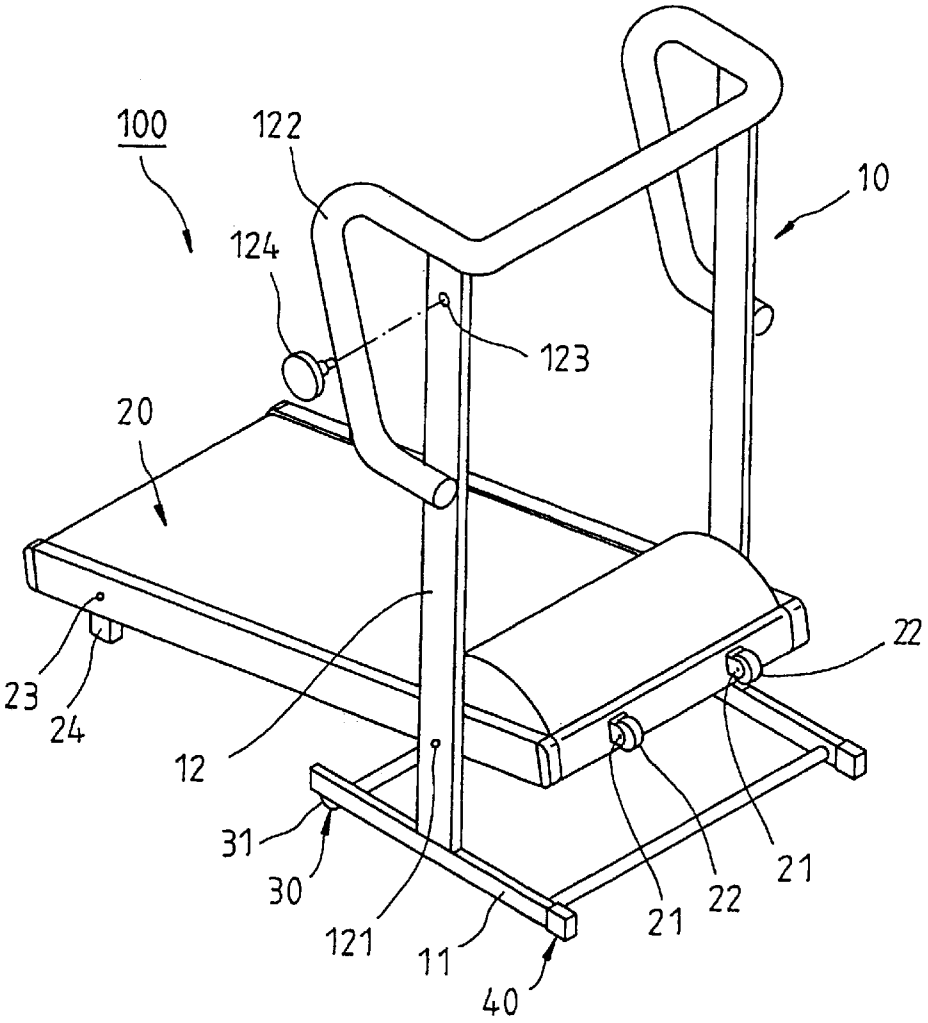
FIG. 3 shows a schematic perspective view of a first preferred embodiment of the present invention.

As shown in FIG. 3, a jogging machine 100 embodied in the present invention comprises a main frame 10 and a jogging seat 20 pivoted to the main frame 10.

The main frame 10 has a base frame 11 and an upright support frame 12 mounted on the base frame 11. The base frame 11 is provided in the rear segment thereof with two caster sets 30, with each having a caster 31 in contact with the floor. The base frame 11 is further provided in the front segment thereof with two skidproof pads 40. The upright support frame 12 is provided in the lower portions thereof with two pivoting portions 121 opposite to each other, and in the upper portions thereof with two hand rails 122. The upright support frame 12 is further provided in the proximity of the tops thereof with one through hole 123 and one pin 124.

Figure 1:
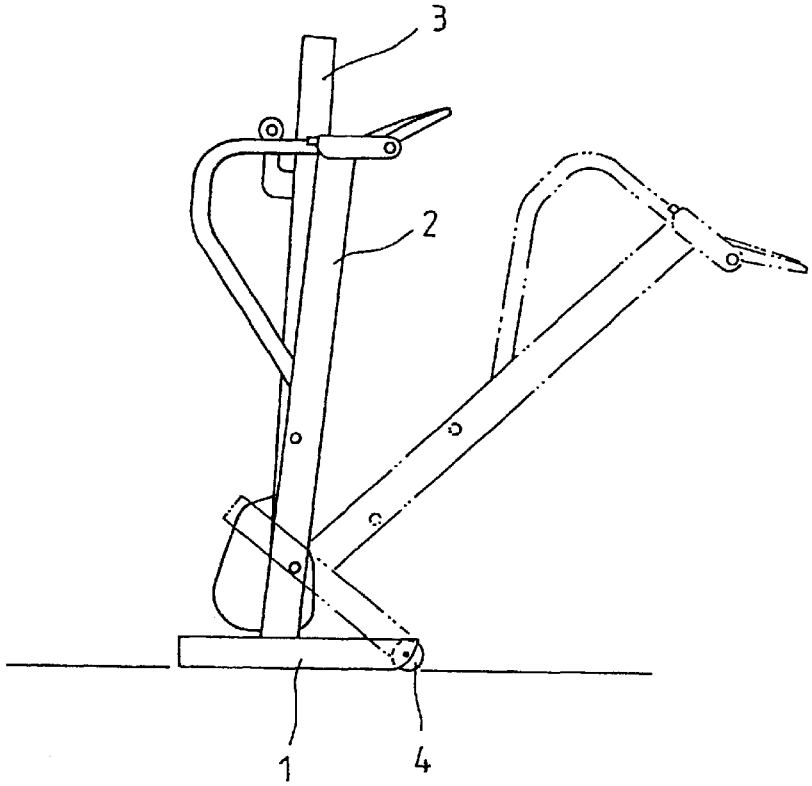
FIG. 1 PRIOR ART
FIG. 1 shows a schematic view of a prior art jogging machine.
Figure 2:
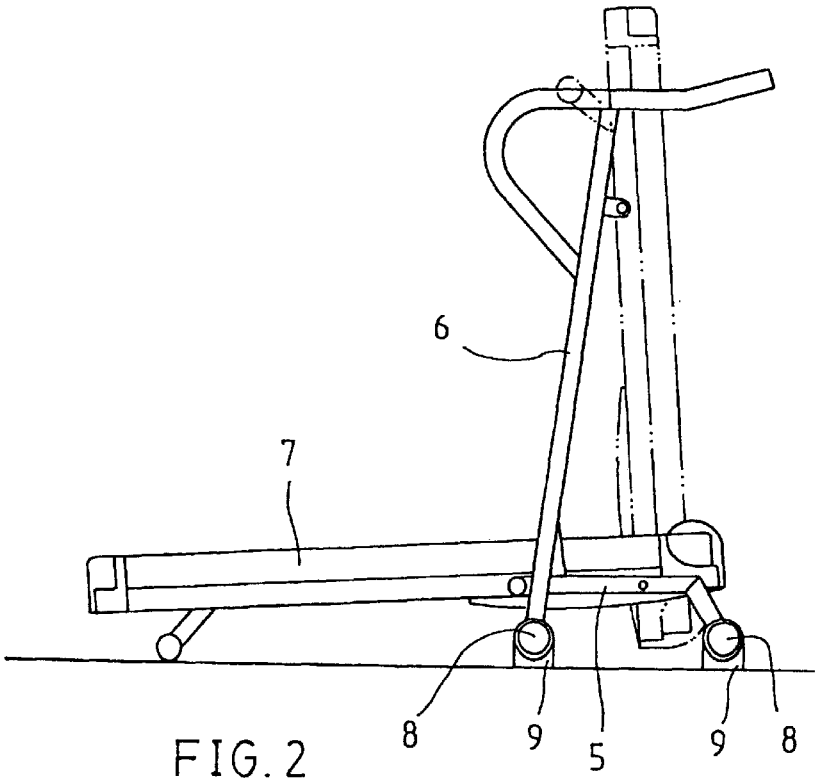
FIG. 2 PRIOR ART
FIG. 2 shows a schematic view of another prior art jogging machine.
Figure 4:
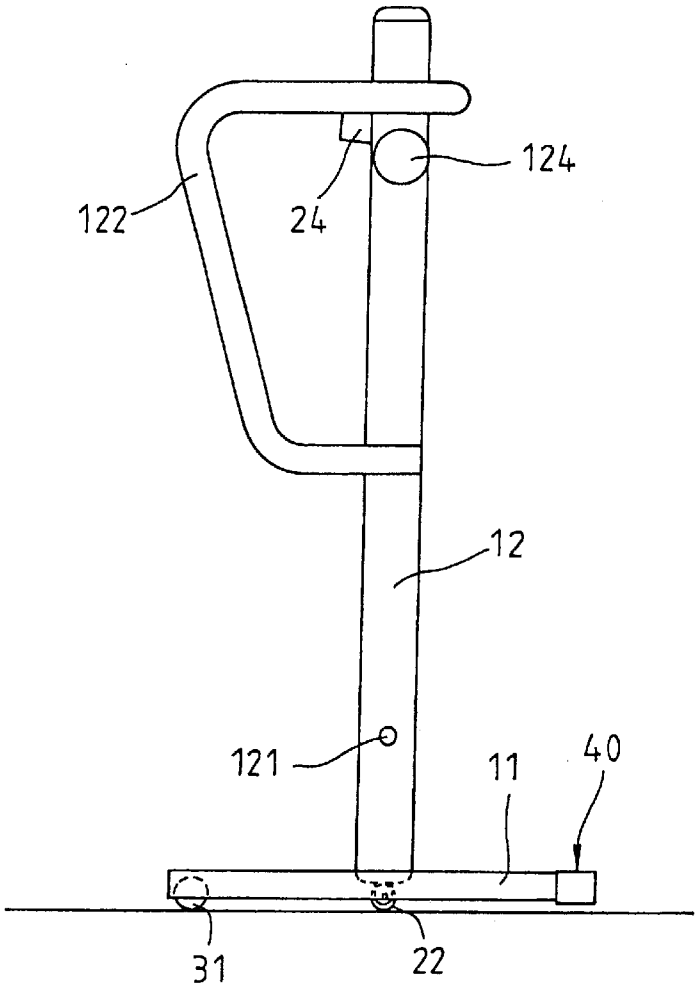
FIG. 4 is a schematic view showing that the jogging seat of the first preferred embodiment of the present invention is raised upright for easier movement of the jogging machine.

The jogging seat 20 is fastened with the pivoting portions 121 of the upright support frame 12 such that the front end of the jogging seat 20 is jutted out of the upright support frame 12. The jogging seat 20 is provided in the side wall of the front end thereof with two U-shaped roller frames 21, with each being provided with a roller 22 pivoted thereto. As the jogging seat 20 is raised upright, the two rollers 22 come in contact with the floor, as shown in FIG. 4. As a result, the entire jogging machine 100 is supported on the floor by the two rollers 22 and the two casters 31. The jogging seat 20 is further provided in one of the two longitudinal side walls thereof with an insertion hole 23 corresponding in location to the through hole 123 of the upright support frame 12. The jogging seat 20 is provided in the underside of the rear end thereof with two support feet 24. In operation, the jogging seat 20 is slantingly supported by the support frame 12 such that the two support feet 24 of the rear end of the jogging seat are rested on the floor. In the meantime, the two skidproof pads 40 of the base frame 11 serve to stabilize the jogging machine 100 on the floor. The jogging seat 20 can be turned on the pivoting portions 121 of the support frame 12 to be in an upright position relative to the base frame 11. The upright jogging seat 20 is secured to the support frame 12 by the pin 124 which is inserted into the through hole 123 of the support frame 12 and the insertion hole 23 of the jogging seat 20, as illustrated in FIG. 4. The jogging machine 100 is thus supported by the two rollers 22 and the two casters 31 on the floor such that the two skidproof pads 40 are no longer in contact with the floor, and that the jogging machine 100 can be easily moved around the floor on the two rollers 22 and the two casters 31.

Figure 5:
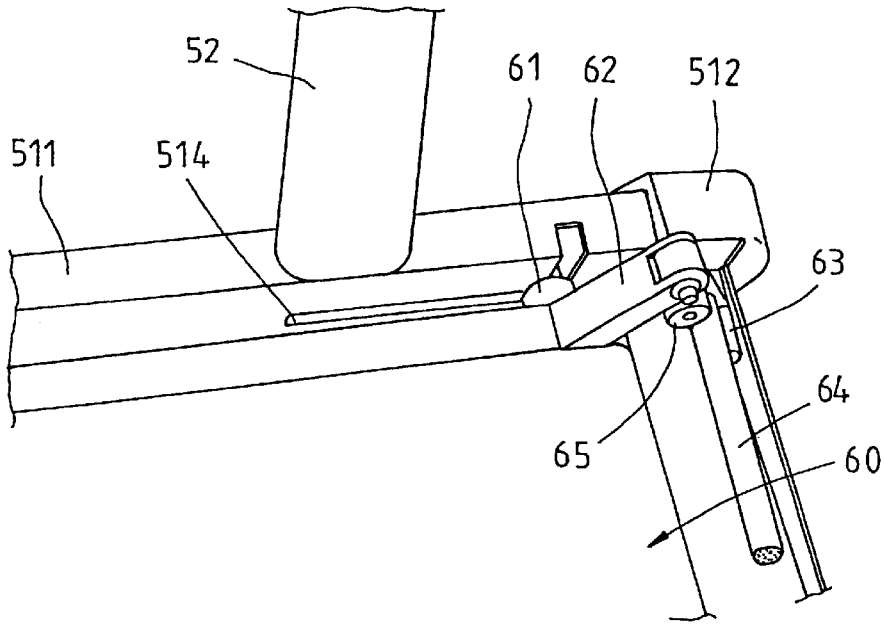
FIG. 5 shows a partial schematic view of a second preferred embodiment of the present invention.
Figure 6:
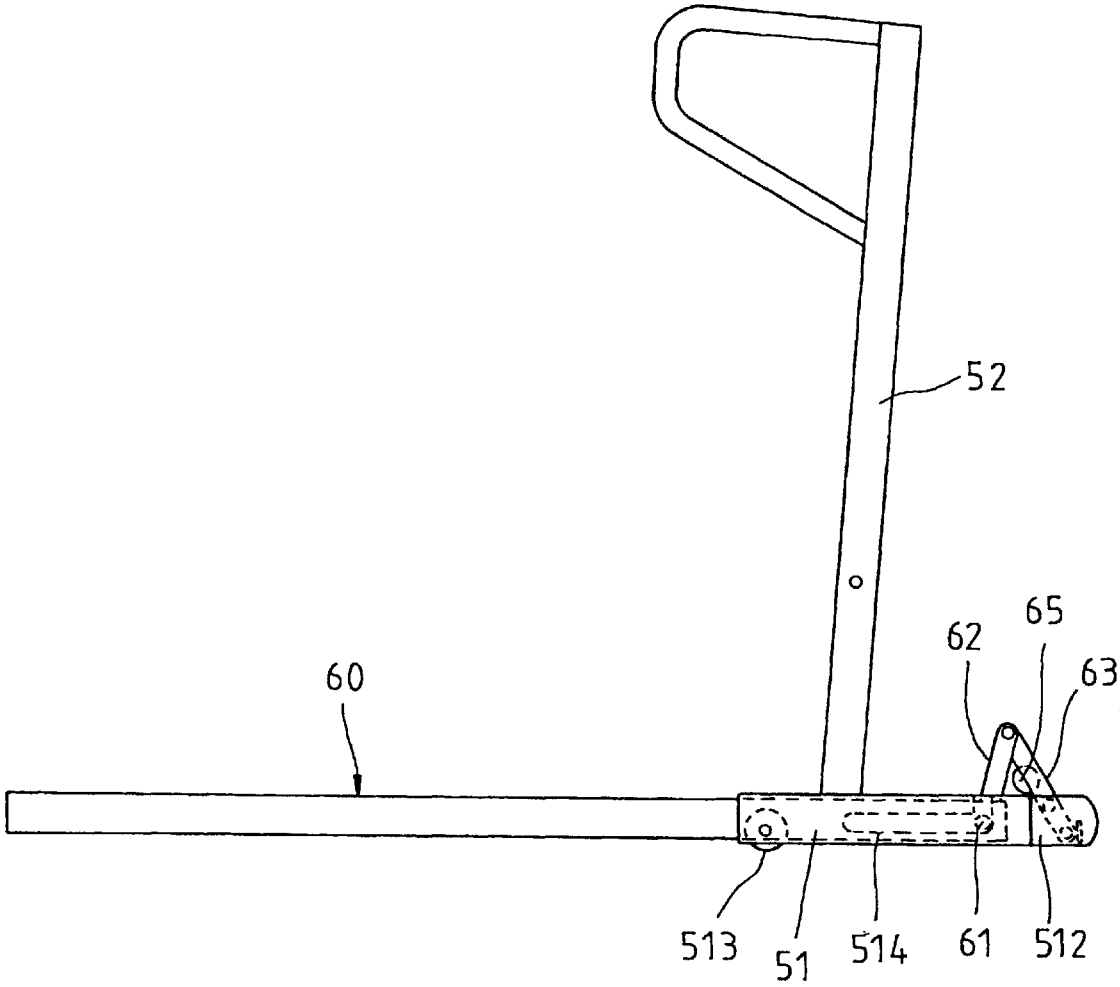
FIG. 6 shows a schematic view of the second preferred embodiment of the present invention in use.

As shown in FIGS. 5 and 6, a jogging machine of the second preferred embodiment of the present invention comprises a main frame 50 and a jogging seat 60. The main frame 50 is formed of a base frame 51 and a support frame 52. The base frame 51 has two bracing rods 511 parallel to each other and having at the front end thereof with a skidproof pad 512 and at the rear end thereof with a slide wheel 513 pivoted thereto. The bracing rods 511 are further provided in the inner side thereof with a slide slot 514. The jogging seat 60 is provided in two outer side walls of the front segment thereof with a guide wheel 61, which is slidably received in the slide slot 514. As the jogging seat 60 is spread out or folded, the guide wheels 61 of the jogging seat 60 slide along the slide slots 514. The jogging seat 60 is further provided at the front end thereof with two connection rods 62 which are fastened pivotally and respectively with a driven rod 63 which is in turn fastened pivotally with the bracing rod 511. The driven rods 63 are reinforced by a cross rod 64 fastened therebetween. The driven rods 63 are provided with a roller 65 pivoted therewith.

Figure 7:
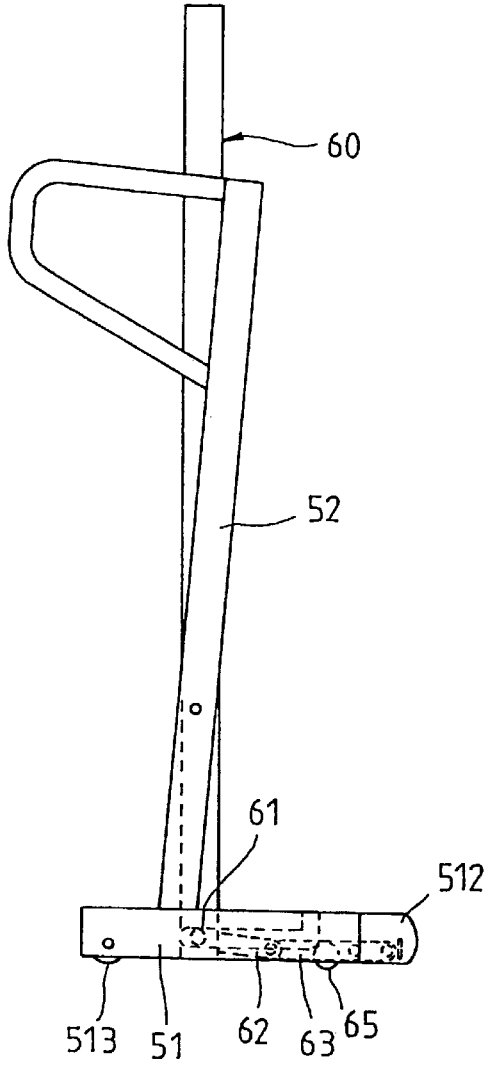
FIG. 7 is a schematic view showing that the jogging seat of the second preferred embodiment of the present invention is raised upright for easier movement of the jogging machine.

In operation, the jogging seat 60 is located horizontally and securely. The skidproof pads 512 serve to stabilize the jogging machine on the floor. As the jogging seat 60 is lifted upright, as shown in FIG. 7, the guide wheels 61 move rearwards, thereby causing the connection rods 62 to actuate the driven rods 63 to extend such that the rollers 65 come in contact with the floor, and that the skidproof pads 512 move upward and away from the floor. As a result, the jogging machine is supported by the rollers 65 and the slide wheels 513, which are used for easy movement of the jogging machine on the floor.

What is claimed is:

1. A jogging machine comprising;

a main frame and a jogging seat pivoted to said main frame, said main frame being provided with two casters resting on a floor;

wherein said jogging seat is provided with at least one roller whereby said roller comes in contact with the floor at such time when said jogging seat is raised upright;

wherein said main frame is formed of a base frame rested on the floor, and an upright support frame mounted on said base frame;

wherein said casters are fastened with said base frame; and wherein said jogging seat is pivoted with said upright support frame of said main frame and is provided with two rollers fastened therewith whereby said two rollers come in contact with the floor at such time when said jogging seat is in an upright position perpendicular to said base frame of said main frame.

2. A jogging machine comprising;

a main frame and a jogging seat pivoted to said main frame, said main frame being pivoted with two casters resting on a floor;

wherein said jogging seat is provided with at least one roller whereby said roller comes in contact with the floor at such time when said jogging seat is raised upright;

wherein said main frame is formed of a base frame rested on the floor, and an upright support frame, said base frame having two bracing rods, with each having in an inner side thereof a slide slot;

wherein said jogging seat is provided in two sides of a front end thereof with a guide wheel whereby said guide wheel slides along said slide slot at the time when said jogging seat is turned in relation to said main frame; and wherein said jogging seat is provided in the two sides of the front end thereof with a connection rod which is fastened pivotally with a driven rod whereby said driven rod is pivotally fastened with one of said two bracing rods and is provided with a roller fastened therewith such that said roller comes in contact with the floor at such time when said jogging seat is in an upright position perpendicular to said base frame of said main frame.

* * * * *